US007104080B2

(12) United States Patent
Albertson

(10) Patent No.: US 7,104,080 B2
(45) Date of Patent: Sep. 12, 2006

(54) PHASE-CHANGE COOLING SYSTEM

(75) Inventor: William C. Albertson, Clinton Township, MI (US)

(73) Assignee: General Motors Corporation, Detroit, MI (US)

( * ) Notice: Subject to any disclaimer, the term of this patent is extended or adjusted under 35 U.S.C. 154(b) by 337 days.

(21) Appl. No.: 10/678,458

(22) Filed: Oct. 3, 2003

(65) Prior Publication Data

US 2005/0072176 A1 Apr. 7, 2005

(51) Int. Cl.
*F25D 23/12* (2006.01)
*F25B 41/00* (2006.01)
*B60H 1/32* (2006.01)

(52) U.S. Cl. ..... 62/259.2; 62/513; 62/113; 62/239

(58) Field of Classification Search ..... 62/259.2, 62/513, 113, 239; 165/80.4, 104.21, 104.33; 361/700

See application file for complete search history.

(56) References Cited

U.S. PATENT DOCUMENTS 5,878,589 A * 3/1999 Tanaka et al. ..... 62/199
5,974,812 A * 11/1999 Katai et al. ..... 62/118
6,116,040 A * 9/2000 Stark ..... 62/259.2
6,772,603 B1 * 8/2004 Hsu et al. ..... 62/259.2
2001/0017039 A1 * 8/2001 Weimer

FOREIGN PATENT DOCUMENTS

JP 05-215457 * 8/1993

OTHER PUBLICATIONS

Hayashi et al., Device for Cooling Electronics, Mar. 2001, JPO 2001-85883, all.*

* cited by examiner

*Primary Examiner*—Cheryl Tyler
*Assistant Examiner*—B. Clayton McCraw
(74) *Attorney, Agent, or Firm*—Christopher DeVries

(57) ABSTRACT

A phase-change cooling system for a vehicle includes an electronic control device for receiving power from a power source and having a first temperature. The phase-change cooling system also includes a condenser of an air conditioning system of the vehicle thermally communicating with the electronic control device and having a second temperature less than the first temperature to remove heat from the electronic control device due to a phase-change of coolant in the condenser.

9 Claims, 2 Drawing Sheets

PHASE-CHANGE COOLING SYSTEM

TECHNICAL FIELD

The present invention relates generally to cooling systems for vehicles and, more particularly, to a phase-change cooling system for a vehicle.

BACKGROUND OF THE INVENTION

It is known to provide high power electronic control devices for a vehicle such as a hybrid vehicle. Typically, the electronic control devices are connected by electric power cables to a power source such as a belt driven alternator/starter. In operation, these electronic control devices create high levels of heat energy. The performance of the electronic control devices becomes greatly diminished if the heat that these devices generate is not removed rapidly. In internal combustion/electric hybrid vehicles, various heat transfer systems have been developed to remove heat from the electronic control devices to maintain their efficiency. For example, the electronic control device may be an electronic control module with an independently pumped glycol cooling system separate from the cooling system of the vehicle. As a result, these heat transfer systems require energy to operate (e.g., coolant pumps).

Often the cooling systems used to limit the temperature in hybrid electronic control modules are complicated, costly, contain combustible fluids, and are difficult to package. Furthermore, dedicated cooling systems that use circulating coolant have a parasitic electrical load from the recirculation pumps used.

As a result, it is desirable to provide a cooling system for a vehicle that removes heat from control devices. It is also desirable to provide a cooling system for electronic control devices that eliminates combustible fluids and is less costly. It is further desirable to provide a cooling system for electronic control devices that is not complicated and difficult to package. Therefore, there is a need in the art to provide a cooling system that meets these desires.

SUMMARY OF THE INVENTION

It is, therefore, one object of the present invention to provide a new cooling system for a vehicle.

It is another object of the present invention to provide a cooling system for a vehicle to cool electronic control devices.

To achieve the foregoing objects, the present invention is a phase-change cooling system for a vehicle. The phase-change cooling system includes an electronic control device for receiving power from a power source and having a first temperature. The phase-change cooling system also includes a condenser of an air condition system of the vehicle thermally communicating with the electronic control device and having a second temperature less than the first temperature to remove heat from the electronic control device due to a phase-change of coolant in the condenser.

One advantage of the present invention is that a phase-change cooling system is provided for a vehicle such as a hybrid vehicle to cool electronic control device. Another advantage of the present invention is that the phase-change cooling system takes advantage of an existing heat transfer system, resulting in a reduction in weight, size, parts, electrical energy, service, and overall cost. Yet another advantage of the present invention is that the phase-change cooling system is flush mounted to a condenser of the air conditioning system for a vehicle. Still another advantage of the present invention is that the phase-change cooling system removes heat by sensible heat differential and, to a higher degree, by the thermally driven phase-change of the liquid refrigerant present in the condenser of the air conditioning system.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
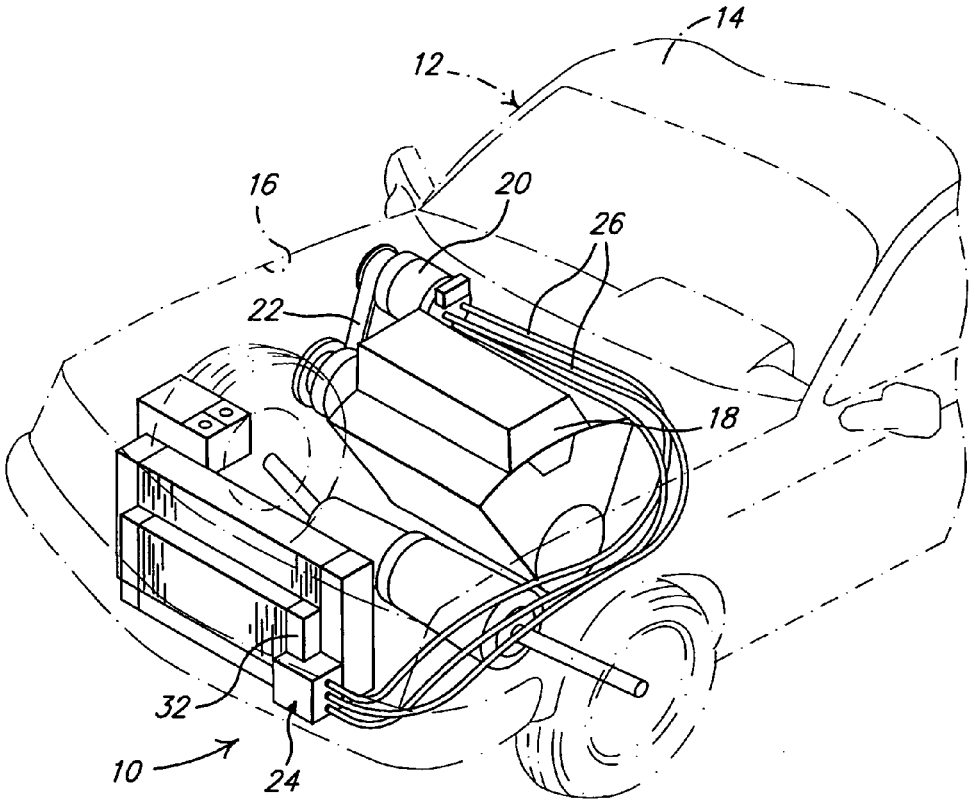
FIG. 1 is a perspective view of a phase-change cooling system, according to the present invention, illustrated in operational relationship with a vehicle.

Referring to the drawings and in particular FIG. 1, one embodiment of a phase-change cooling system 10, according to the present invention, is shown for a vehicle, partially shown in phantom lines and generally indicated at 12. The vehicle 12 includes a vehicle body 14 having an engine compartment 16. The vehicle 12 also includes an engine 18 disposed in the engine compartment 16 and an alternator/starter motor 20 operatively coupled to the engine 18 via a belt 22. It should be appreciated that the alternator/starter motor 20 is driven by the engine 18 via the belt 22. It should also be appreciated that the phase change cooling system 10 is illustrated for a belt alternator/starter hybrid vehicle. It should further be appreciated that the phase change cooling system 10 may be used for a flywheel alternator/starter hybrid vehicle. It should still further be appreciated that, except for the phase change cooling system 10, the vehicle 12 is conventional and known in the art.

Figure 2:
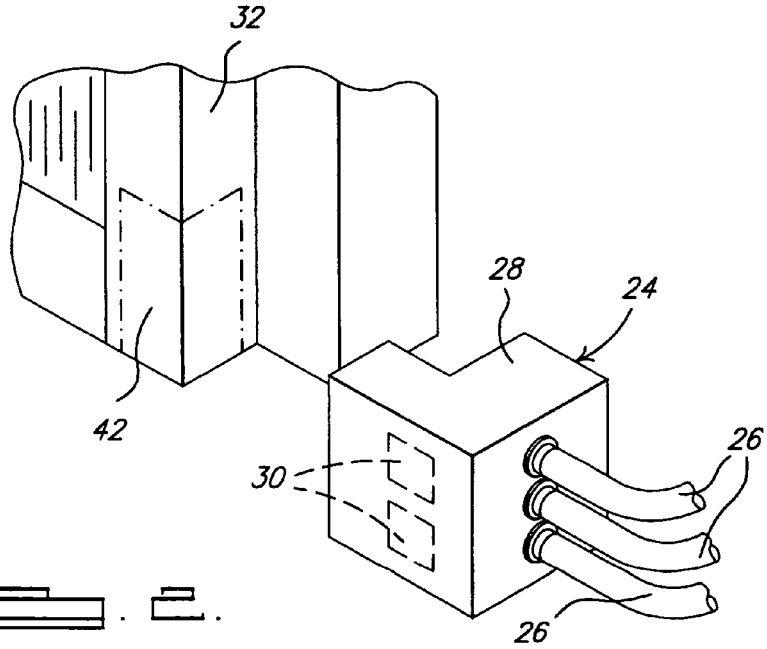
FIG. 2 is an enlarged exploded view of a portion of the phase-change cooling system of FIG. 1.
Figure 3:
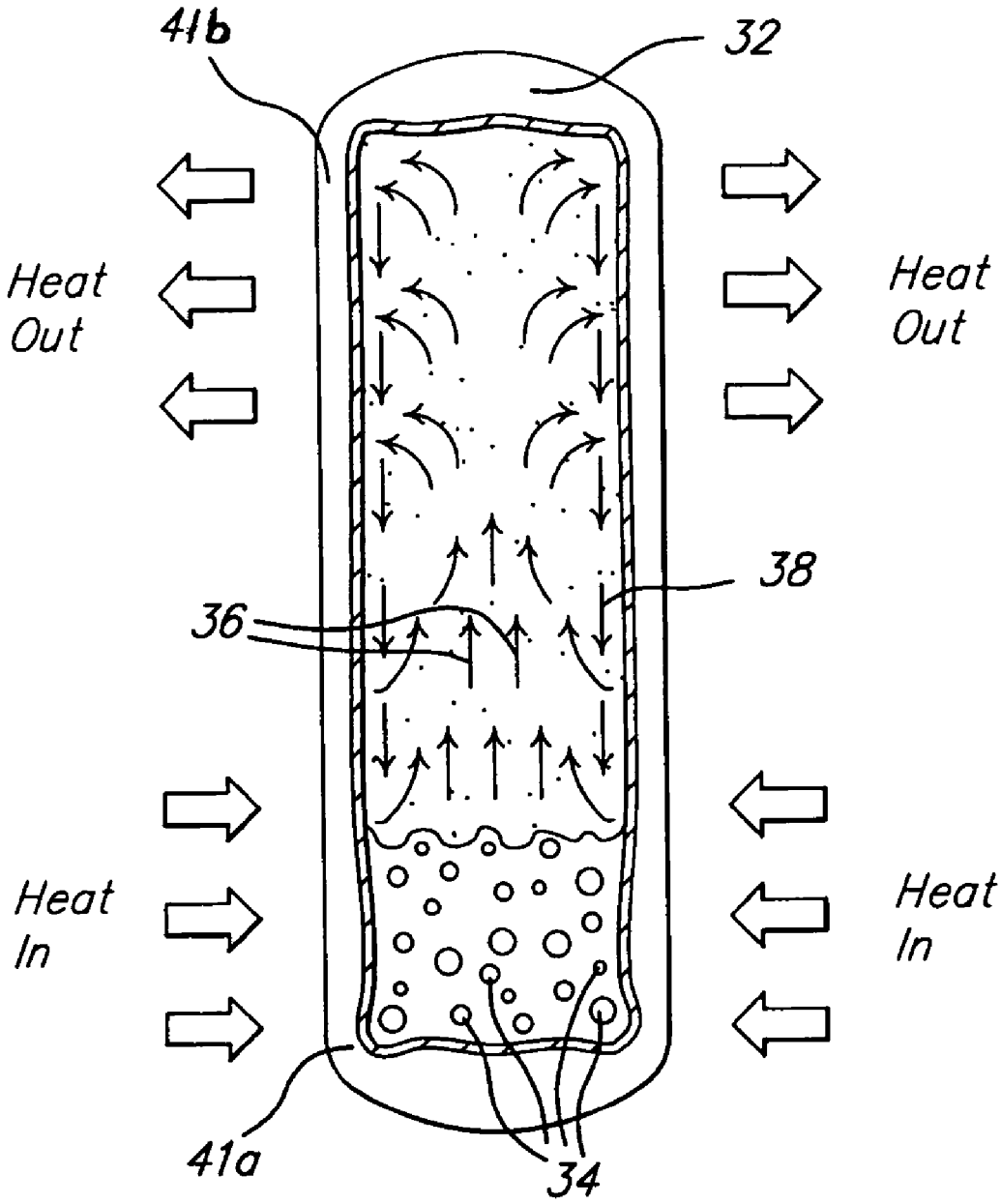
FIG. 3 is a fragmentary elevational view of a condenser of the phase-change cooling system of FIG. 1.

Referring to FIGS. 1 through 3, the phase change cooling system 10 includes a high power electronic control device, generally indicated at 24, such as an electronic control module. The electronic control device 24 is electrically connected to the alternator/starter motor 20 by electrical power cables 26. The electronic control device 24 has a housing 28 and at least one, preferably a plurality of electronic switches 30 disposed within the housing 28. The housing 28 is made of a conductive metal material such as aluminum. The electronic switches 30 are of a semiconductor type. It should be appreciated that the electric power cables 26 provide electrical power to the electronic switches 30, which have a high heat output. It should also be appreciated that the electronic switches 30 are conventional and known in the art.

The phase change cooling system 10 further includes a heat pipe such as a condenser 32 connected to the electronic control device 24. The condenser 32 is part of the air conditioning system for the vehicle 12. The condenser 32 has a coolant contained therein in the form of a working fluid liquid such as a liquid refrigerant 34 and as a working fluid vapor such as a vapor refrigerant 36 as the illustrated in FIG. 3. The vapor refrigerant 36 rises in the condenser 32 and returns as a condensed working fluid 38. The condenser 32 includes a lower portion 41*a* and an upper portion 41*b*. The condenser 32 also includes a thermal interface 42 to thermally communicate with the housing 28 of the electronic control device 24. The thermal interface 42 may be made of a conductive metal material such as aluminum. The thermal interface 42 is located on the lower portion 41*a* of the condenser 37. It should be appreciated that, in another embodiment, the condenser 32 and housing 28 of the electronic control device 24 are integrated to allow direct contact of the liquid refrigerant 34 with the electronic switches 28. It should also be appreciated that the condenser 32 removes heat from and cools the electronic control device 24. It should further be appreciated that heat is removed by sensible heat differential and, to a higher degree, by a thermally driven phase-change of the liquid refrigerant 34 present in the condenser 32.

In operation, the electronic switches 28 generate heat as a result of receiving power from the alternator/starter motor 20 via the electric power cables 26. The electronic control device 24 thermally communicates with the condenser 32 to transfer heat from the electronic control device 24 to the condenser 32. The heat from the electronic control device 24 is transferred via the thermal interface 42 to the liquid refrigerant 34 in the lower portion 41*a* of the condenser 32. The lower portion 41*a* of the condenser 32 contains a substantial volume of liquid refrigerant 34 at below its own boiling temperature. The heat input causes the liquid refrigerant 34 to boil and thus absorb a great amount of heat due to the phase change from liquid to vapor. The maximum temperature of the refrigerant at this location is approximately 70° C. and the temperature at which the electronic control device 24 starts to deteriorate is approximately 106° C. During phase-change cooling, the vaporized refrigerant naturally convects to the upper portion 41*b* of the condenser 32 where it is re-condensed to liquid. It should be appreciated that the thermal proximity of the liquid refrigerant 34 absorbs heat from the electronic control device 24 by both sensible heat differential and latent heat of boiling.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A phase-change cooling system for a vehicle comprising:

a power source;

an electronic control device for receiving power from said power source and having a first temperature; and a condenser of an air conditioning system of the vehicle having a thermal interface contacting said electronic control device and having a second temperature less than the first temperature to remove heat from said electronic control device due to a phase-change of coolant in said condenser.

2. A phase-change cooling system as set forth in claim 1 wherein said electronic control device comprises a housing and at least one electronic switch disposed within said housing.

3. A phase-change cooling system as set forth in claim 2 wherein said housing is made of a conductive metal material.

4. A phase-change cooling system as set forth in claim 2 wherein said at least one electronic switch is of a semiconductor type.

5. A phase-change cooling system as set forth in claim 2 wherein said thermal interface is disposed between said housing and the coolant.

6. A phase-change cooling system as set forth in claim 1 wherein said thermal interface is made of a conductive metal material.

7. A phase-change cooling system as set forth in claim 1 wherein said thermal interface is located on a lower portion of said condenser.

8. A phase-change cooling system as set forth in claim 1 including a coolant disposed in said condenser having a liquid phase and a vapor phase.

9. A vehicle comprising:

a power source;

at least one electric power cable having one end connected to said power source;

an electronic control device connected to another end of said at least one electric power cable for receiving power from said power source and having a first temperature, said electronic control device comprising a housing and at least one electronic switch disposed within said housing; and a condenser of an air conditioning system of said vehicle having a coolant disposed therein and a thermal interface located on a lower portion of said condenser and contacting said housing of said electronic control device, said condenser having a second temperature less than the first temperature to remove heat from said electronic control device due to a phase-change of said coolant in said condenser.

* * * * *